US010446354B1

(12) United States Patent
Rosios et al.

(10) Patent No.: US 10,446,354 B1
(45) Date of Patent: Oct. 15, 2019

(54) COILED FUSIBLE ELEMENT FOR HIGH RELIABILITY FUSE

(71) Applicant: Littelfuse, Inc., Chicago, IL (US)

(72) Inventors: Maria Lily E. Rosios, Masbate (PH); Marko Arciaga, Batangas (PH); Hilda Hidalgo, Batangas (PH)

(73) Assignee: LITTELFUSE, INC., Chicago, IL (US)

( * ) Notice: Subject to any disclaimer, the term of this patent is extended or adjusted under 35 U.S.C. 154(b) by 0 days.

(21) Appl. No.: 16/162,846

(22) Filed: Oct. 17, 2018

(51) Int. Cl.
*H01H 85/38* (2006.01)
*H01H 85/055* (2006.01)

(52) U.S. Cl.
CPC ..... *H01H 85/055* (2013.01); *H01H 85/38* (2013.01); *H01H 2085/388* (2013.01)

(58) Field of Classification Search
CPC . H01H 85/055; H01H 85/38; H01H 2085/388
USPC ..... 337/159
See application file for complete search history.

(56) References Cited

U.S. PATENT DOCUMENTS 1,545,550 A * 7/1925 Coates ..... H01H 85/055 337/231
1,757,753 A * 5/1930 Thiery ..... H01H 85/055 337/292
3,002,071 A * 9/1961 Storsand ..... H01H 85/38 337/158
3,368,047 A * 2/1968 McClure, Jr. ..... H01H 85/185 337/228
3,639,874 A * 2/1972 Deelman ..... H01H 85/055 337/185
3,648,210 A * 3/1972 Kozacka ..... H01H 85/042 337/161
3,713,063 A * 1/1973 Foulkes ..... H01H 85/046 337/159
3,713,065 A * 1/1973 Brichant ..... H01H 85/47 337/166
3,742,415 A * 6/1973 Cameron ..... H01H 33/76 337/279
3,849,754 A * 11/1974 Blewitt ..... H01H 85/185 337/231
3,983,524 A * 9/1976 Koch ..... H01H 85/042 337/159
4,460,887 A * 7/1984 McAlear ..... H01H 85/165 337/186
4,506,249 A * 3/1985 Huber ..... H01H 85/143 337/158
4,517,544 A * 5/1985 Spaunhorst ..... H01H 85/055 337/164

(Continued)

FOREIGN PATENT DOCUMENTS

GB 2029131 A * 3/1980 ..... H01H 85/055

*Primary Examiner* — Anatoly Vortman

(57) ABSTRACT

Provided herein are protection devices, such as fuses, including a coiled fusible element. In some embodiments, a fuse includes a body including a center portion extending between a first end and a second end, and a first endcap surrounding the first end and a second endcap surrounding the second end. The fuse may further include a fusible element disposed within a central cavity of the body, wherein the fusible element includes a first coil disposed within the first endcap and a second coil disposed within the second endcap. The fusible element further includes a central wire extending diagonally between the first and second coils.

18 Claims, 5 Drawing Sheets

(56) References Cited

U.S. PATENT DOCUMENTS

| | | | | | |
|---|---|---|---|---|---|
| 4,536,735 | A * | 8/1985 | van der Scheer | H01H 85/055 | 337/158 |
| 4,542,364 | A * | 9/1985 | van der Scheer | H01H 85/157 | 337/252 |
| 4,736,180 | A * | 4/1988 | Oh | H01H 85/055 | 337/163 |
| 4,972,169 | A * | 11/1990 | Kalra | H01H 85/055 | 337/158 |
| 5,485,136 | A * | 1/1996 | Johnson | H01H 9/102 | 337/168 |
| 5,736,919 | A * | 4/1998 | Reeder | H01H 85/185 | 337/206 |
| 6,552,646 | B1 * | 4/2003 | Wong | H01H 85/143 | 337/231 |
| 8,212,646 | B2 * | 7/2012 | Crane | H01H 9/44 | 337/273 |
| 8,299,887 | B2 * | 10/2012 | Ohtsuka | H01H 81/00 | 337/167 |
| 2002/0113684 | A1 * | 8/2002 | Arikawa | H01H 85/0418 | 337/163 |
| 2007/0285867 | A1 * | 12/2007 | Muench | H01H 85/042 | 361/159 |
| 2010/0245025 | A1 * | 9/2010 | de Leon | H01H 85/0418 | 337/290 |

* cited by examiner

COILED FUSIBLE ELEMENT FOR HIGH RELIABILITY FUSE

BACKGROUND

Field

The present disclosure relates generally to fuses. More specifically, the present disclosure relates to fuses including a coiled fusible element.

Description of Related Art

Fuses are used as circuit protection devices and form an electrical connection with a component in a circuit to be protected. One type of fuse includes a fusible element disposed within a hollow fuse body. Upon the occurrence of a specified fault condition, such as an overcurrent condition, the fusible element melts or otherwise opens to interrupt the circuit path and isolate the protected electrical components or circuit from potential damage. Such fuses may be characterized by the amount of time required to respond to an overcurrent condition. In particular, fuses that comprise different fusible elements respond with different operating times since different fusible elements can accommodate varying amounts of current through the fusible element. Thus, by varying the size and type of fusible element, different operating times may be achieved.

When an overcurrent condition occurs, an arc may be formed between the melted portions of the fusible element. If not extinguished, this arc may further damage the circuit to be protected by allowing unwanted current to flow to circuit components. Thus, it is desirable to manufacture fuses which extinguish this arc as quickly as possible. In addition, as fuses decrease in size to accommodate ever smaller electrical circuits, there is a need to reduce manufacturing costs of these fuses. This may include reducing the number of components and/or using less expensive components, as well as reducing the number and/or complexity of associated manufacturing steps.

Consequently, there is a need to reduce the number of components and/or manufacturing steps to produce a fuse with improved arc extinguishing characteristics. It is with respect to these and other considerations that the present improvements have been needed.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

In some approaches according to the disclosure, a fuse includes a body including a center portion extending between a first end and a second end, and a first endcap surrounding the first end and a second endcap surrounding the second end. The fuse may further include a fusible element disposed within a central cavity of the body, the fusible element including a first coil disposed within the first endcap and a second coil disposed within the second endcap. The fusible element may further include a central wire extending diagonally between the first and second coils.

In some approaches according to the disclosure, a protection device may include a body, and a first endcap surrounding a first end of the body and a second endcap surrounding a second end of the body. In some embodiments, a fusible element may extend between the first end of the body and the second end of the body, wherein the fusible element is disposed within a central cavity of the body. The fusible element may include a first coil disposed within the first endcap and a second coil disposed within the second endcap. The fusible element may further include a central wire extending diagonally between the first and second coils.

In some approaches according to the disclosure, a fusible device may include a hollow body, and a first endcap surrounding a first end of the hollow body and a second endcap surrounding a second end of the hollow body. The fusible device may further include a fusible element extending between the first end of the body and the second end of the body, wherein the fusible element is disposed within a central cavity of the hollow body. The fusible element may include a first coil partially disposed within the first endcap, the first coil having a plurality of loops wound about a central axis. The fusible element may further include a central wire having a first end integrally coupled to the first coil, the central wire extending diagonally through the central cavity with respect to the central axis. The fusible element may further include a second coil having a second end integrally coupled to the second coil, the second coil having a plurality of loops wound about the central axis.

BRIEF DESCRIPTION OF THE DRAWINGS

The accompanying drawings illustrate exemplary approaches of the disclosed embodiments so far devised for the practical application of the principles thereof, and in which.

Figure 1:
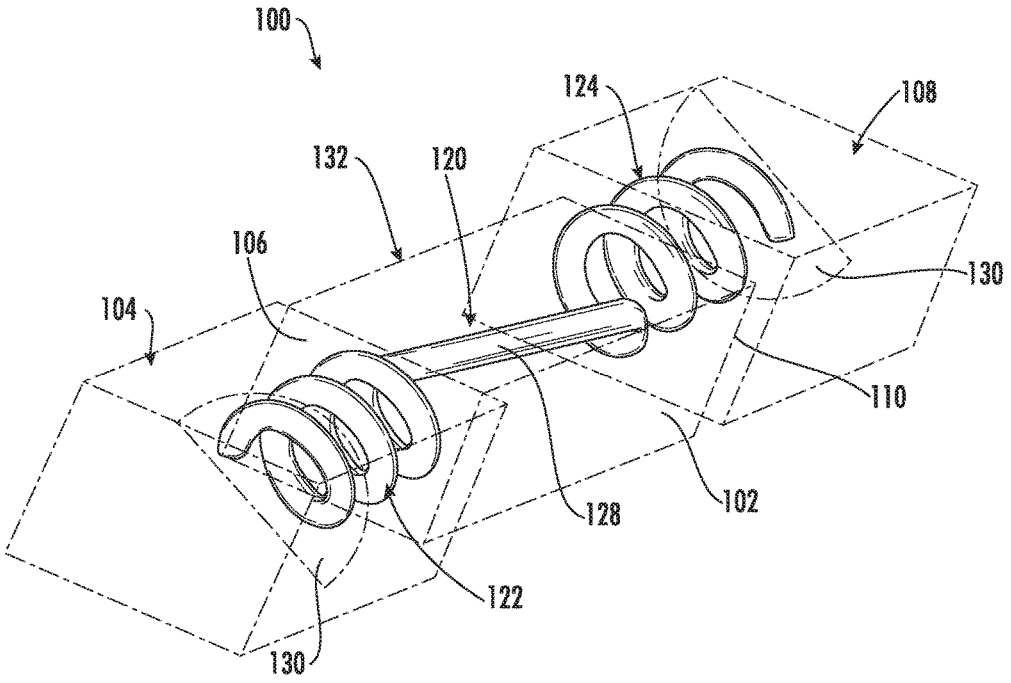
FIG. 1 illustrates a fuse according to embodiments of the disclosure.

The drawings are not necessarily to scale. The drawings are merely representations, not intended to portray specific parameters of the disclosure. The drawings are intended to depict typical embodiments of the disclosure, and therefore should not be considered as limiting in scope. In the drawings, like numbering represents like elements.

Furthermore, certain elements in some of the figures may be omitted, or illustrated not-to-scale, for illustrative clarity. Furthermore, for clarity, some reference numbers may be omitted in certain drawings.

DETAILED DESCRIPTION

Embodiments in accordance with the present disclosure will now be described more fully hereinafter with reference to the accompanying drawings. The devices/systems/fuses may be embodied in many different forms and should not be construed as being limited to the embodiments set forth herein. Rather, these embodiments are provided so that this disclosure will be thorough and complete, and will fully convey the scope of the system and method to those skilled in the art.

As will be discussed in greater detail herein, the disclosure provides protection devices, such as fuses, having a fusible element including coiled ends and a central wire extending diagonally between the coiled ends. The fusible element may be used for high breaking capacity fuse applications, and bears at least the following features and technical advantages. First, the coiled fusible element free ends promote robust element-termination bonding/connection beneficial for thermal cycling reliability. For example, in one embodiment, the coiled free ends provide good solder coverage for Nano fuses. In another embodiment, the coiled free ends provide a good mechanical bond with mechanical structures, such as tubes, of the endcaps in the case of a solderless design.

Second, the coiled fusible element effectively lengthens the wire element, which results in higher I2t values applicable to high surge applications. The higher the I2t value, the higher the surge or in-rush current and more loading cycles the fuse could withstand before opening, which is typical in LED lighting, AC/DC power adaptor and Telecom equipment system. Third, the coil loops, when supplied with an electric current, create a magnetic field which helps confine arc plasma, enhancing the breaking capacity of the fuse.

Fourth, an interior area of the coil loops provides an area to hold an arc quenching material, such as silicone, for additional arc quenching capability. The diameter of the coil loops, which is dependent on the body/enclosure area, also help aids in the alignment of the fusible element.

Fifth, providing a straight diagonal central wire of the fusible element ensures the weak spot to be at the center of the fusible element, giving faster and safer clearing time. Additionally, the diagonal orientation eliminates or minimizes issues of the central wire touching the body, which is a common root cause of standard Nano OL failure.

FIG. 1 illustrates a perspective view of a protection device, such as a fuse 100, in accordance with a non-limiting embodiment of the present disclosure. As shown, the fuse 100 may include a body 102. The body 102 may be ceramic, plastic, or other suitable electrically non-conducting material. In exemplary embodiments, the body 102 is hollow. A first endcap 104 may be coupled to, or fit over, a first end 106 of the body 102, and a second endcap 108 may be coupled to, or fit over, a second end 110 of the body 102.

The fuse 100 further includes a fusible element 120, such as wire. The fusible element 120 may be disposed within the body 102. As shown, the fusible element 120 includes a first coil 122 coupled to the first endcap 104 and a second coil 124 coupled to the second endcap 108. Extending diagonally between the first and second coils 122, 124 is a central wire 128. In some embodiments, the central wire 128 may be substantially straight.

In some embodiments, solder 130 may be disposed within each of the first and second endcaps 104 and 108. More specifically, the solder 130 may be disposed between the first end 106 of the body 102 and the first endcap 104, and between the second end 110 of the body 102 and the second endcap 108. As shown, the solder 130 may be electrically and mechanically connected to the first coil 122 and the second coil 124.

In some embodiments, the body 102 includes a central portion 132 extending between the first and second ends 106, 110. The central portion 132 has an outer cross-sectional profile of a first size. In some embodiments, the first and second ends 106, 110 of the body 102 have an outer cross-sectional profile of a second size, where the second size is less than the first size. However, the first size and the second size may be the same in other embodiments.

The fusible element 120 extends through a cavity that is defined between an outer periphery of the first end 106 and an inside surface of the first endcap 104. The fusible element 120 extends along a substantially diagonal path through a center of the cavity and terminates at the second end 110, which is at least partially covered by the second endcap 108. The cavity enables the solder 130 to completely surround at least a portion of the fusible element 120 disposed therein. In exemplary embodiments, the fusible element 120 does not come into direct contact with the interior surfaces of the body 102 defining the cavity.

Figure 2:
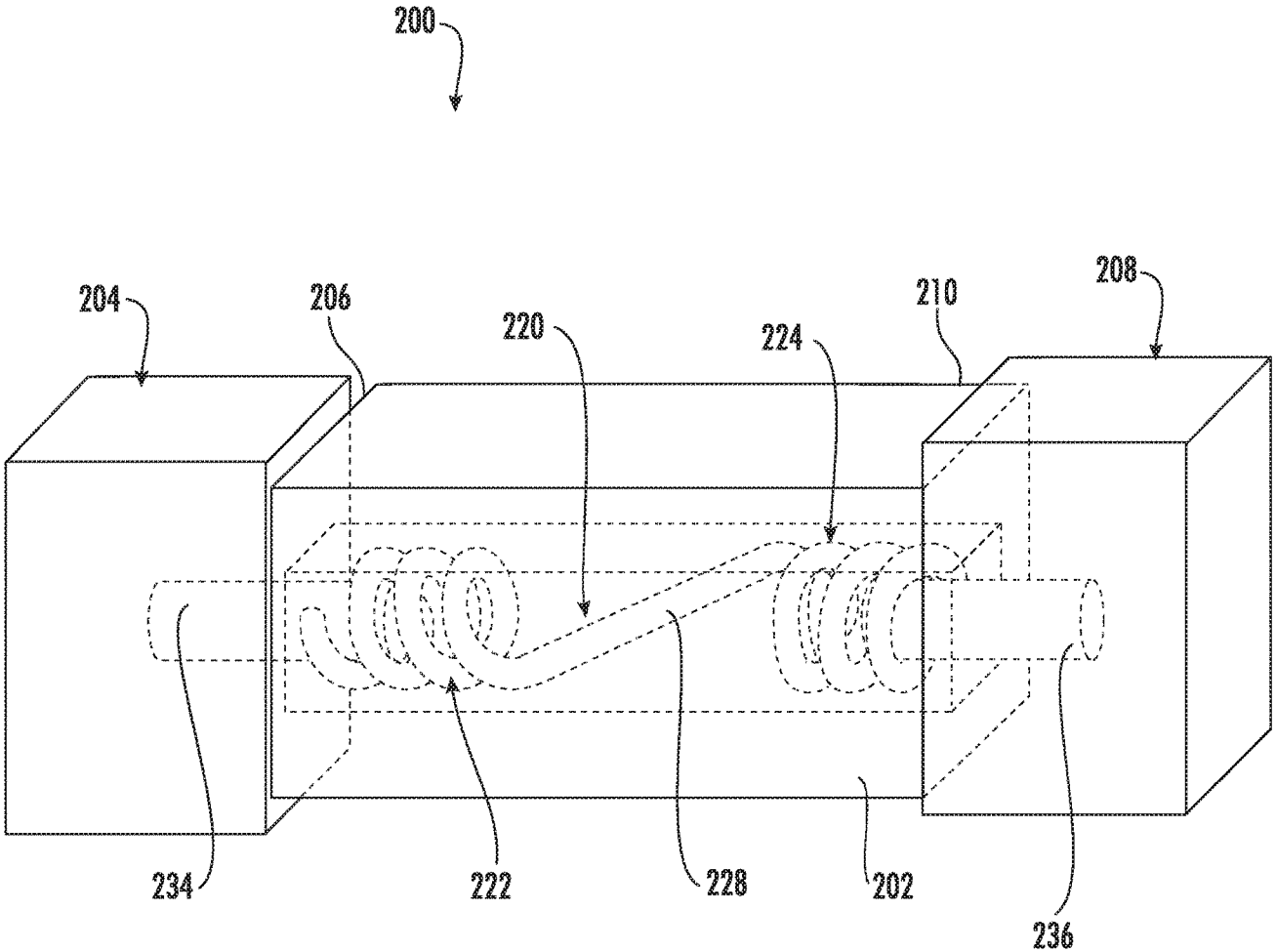
FIG. 2 illustrates a fuse according to embodiments of the disclosure.

FIG. 2 illustrates a perspective view of a protection device, such as a fuse 200, in accordance with a non-limiting embodiment of the present disclosure. The fuse 200 may share many of the same features to the fuse 100 described above. As such, some aspects of the fuse 200 may not be described in detail for the sake brevity. As shown, the fuse 200 may include a body 202. The body 202 may be ceramic, plastic, or other suitable electrically non-conducting material. In exemplary embodiments, the body 202 is hollow. A first endcap 204 may be coupled to, or fit over, a first end 206 of the body 202, and a second endcap 208 may be coupled to, or fit over, a second end 210 of the body 202.

The fuse 200 further includes a fusible element 220, such as wire. The fusible element 220 may be disposed within the body 202. As shown, the fusible element 220 includes a first coil 222 coupled to the first endcap 204 and a second coil 224 coupled to the second endcap 208. Extending diagonally between the first and second coils 222, 224 is a central wire 228. In some embodiments, the central wire 228 may be substantially straight.

In this non-limiting embodiment, the fuse 200 may be solderless. Instead, the first coil 222 is coupled to, or wound about, a first tube 234 of the first endcap 204. The second coil 224 is coupled to a second tube 236 of the second endcap 208. The first tube 234 and the second tube 236 may be an type of post or support extending from respective endcaps 204, 208 towards the body 202. In one embodiment, the first and second tubes 234, 236 may each be metallica tubes.

The fusible element 220 extends through a cavity that is defined between an outer periphery of the first end 206 and an inside surface of the first endcap 204. The fusible element 220 extends along a substantially diagonal path through a center of the cavity and terminates at the second end 210, which is at least partially covered by the second endcap 208. In exemplary embodiments, the fusible element 220 does not come into direct contact with the interior surfaces of the body 202 defining the cavity.

Figure 3:
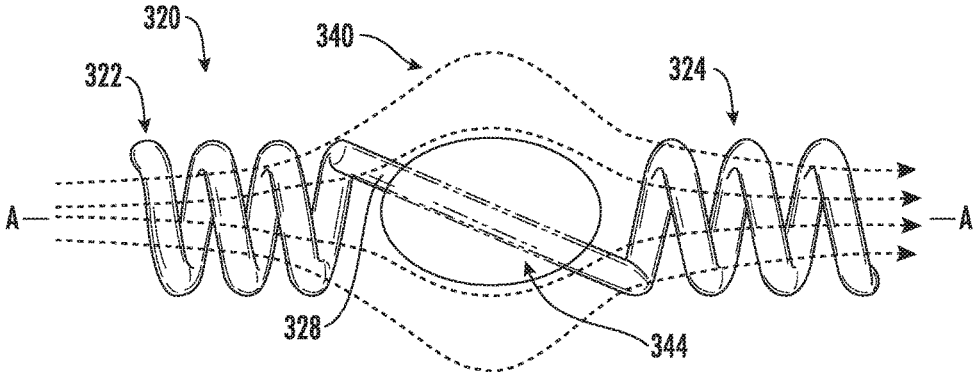
FIG. 3 illustrates an example fusible element according to embodiments of the disclosure.

Turning now to FIG. 3, a fusible element 320 according to embodiments of the present disclosure will be described in greater detail. The fusible element 320 may be the same or similar to the fusible element 120 and fusible element 220 described above. As shown, the fusible element 320 may include a first coil 322 opposite a second coil 324. A central wire 328 extends diagonally between the first and second coils 322, 324. As shown, each of the first and second coils 322, 324 may include a plurality of loops winding generally about a central axis, A-A. Each of the first and second coils 322, 324 may have any number of loops depending on the application. In exemplary embodiments, the central wire 328 is non-parallel with the central axis A-A.

During use, the first and second coils 322, 324 may create a bottle configuration of magnetic lines 340, which can confine an arc 344 around an approximate midpoint of the central wire 328. With the arc 344 confined at the center between the first and second coils 322, 324, damage to the first coil 322, the second coil 324, the body and the endcaps (not shown) is mitigated. In this non-limiting embodiment, the first and second coils 322, 324 are wound in a same direction (e.g., clockwise).

Figure 4:
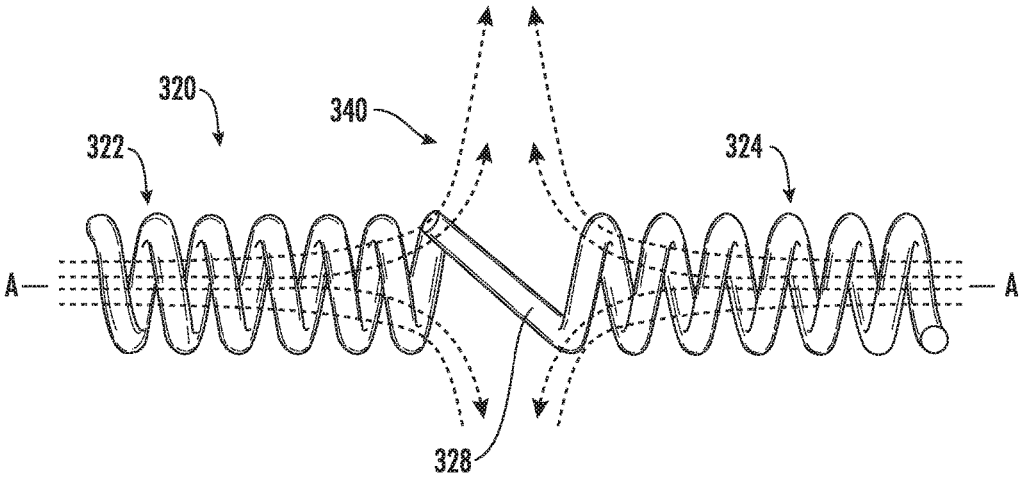
FIG. 4 illustrates an example fusible element according to embodiments of the disclosure.
Figure 5:
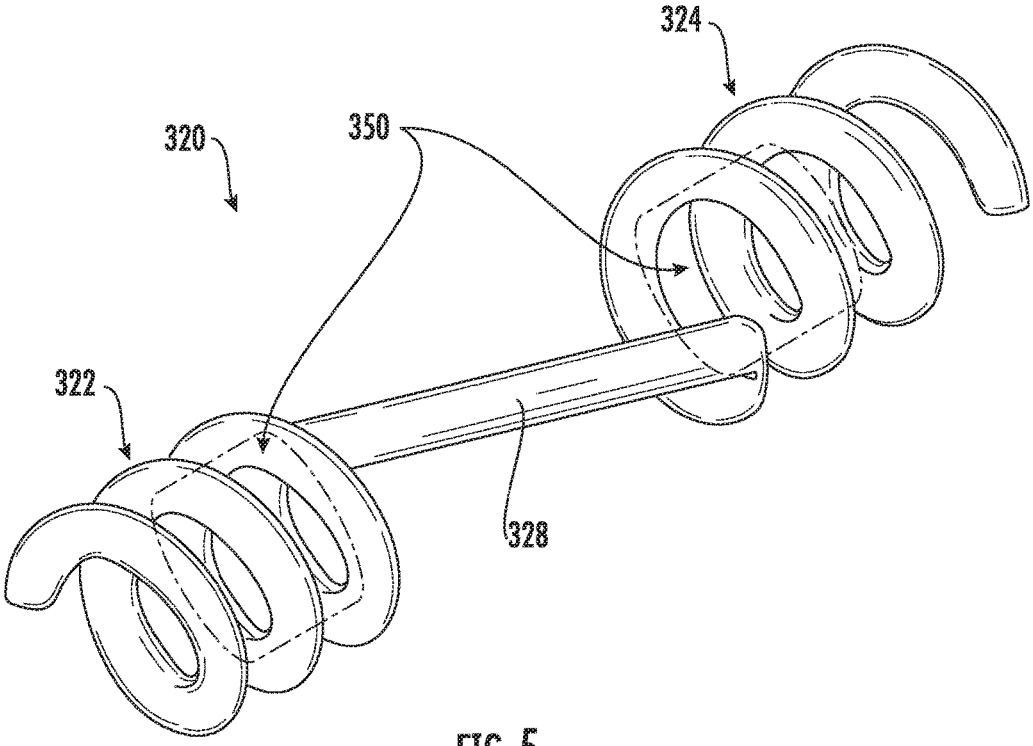
FIG. 5 illustrates an example fusible element according to embodiments of the disclosure.

As shown in FIG. 4, the first and second coils 322, 324 of the fusible element may be wound in opposite directions. In this embodiment, the magnetic field lines 340 create magnetic repulsion between the first and second coils 322, 324. The repulsion aids with separation of the fusible element 320 following a break. In some embodiments, the fusible element 320 may include an arc quencher material 350 (e.g., silicone) within and/or around the first and second coils 322 and 324, as shown in FIG. 5.

Figure 6:
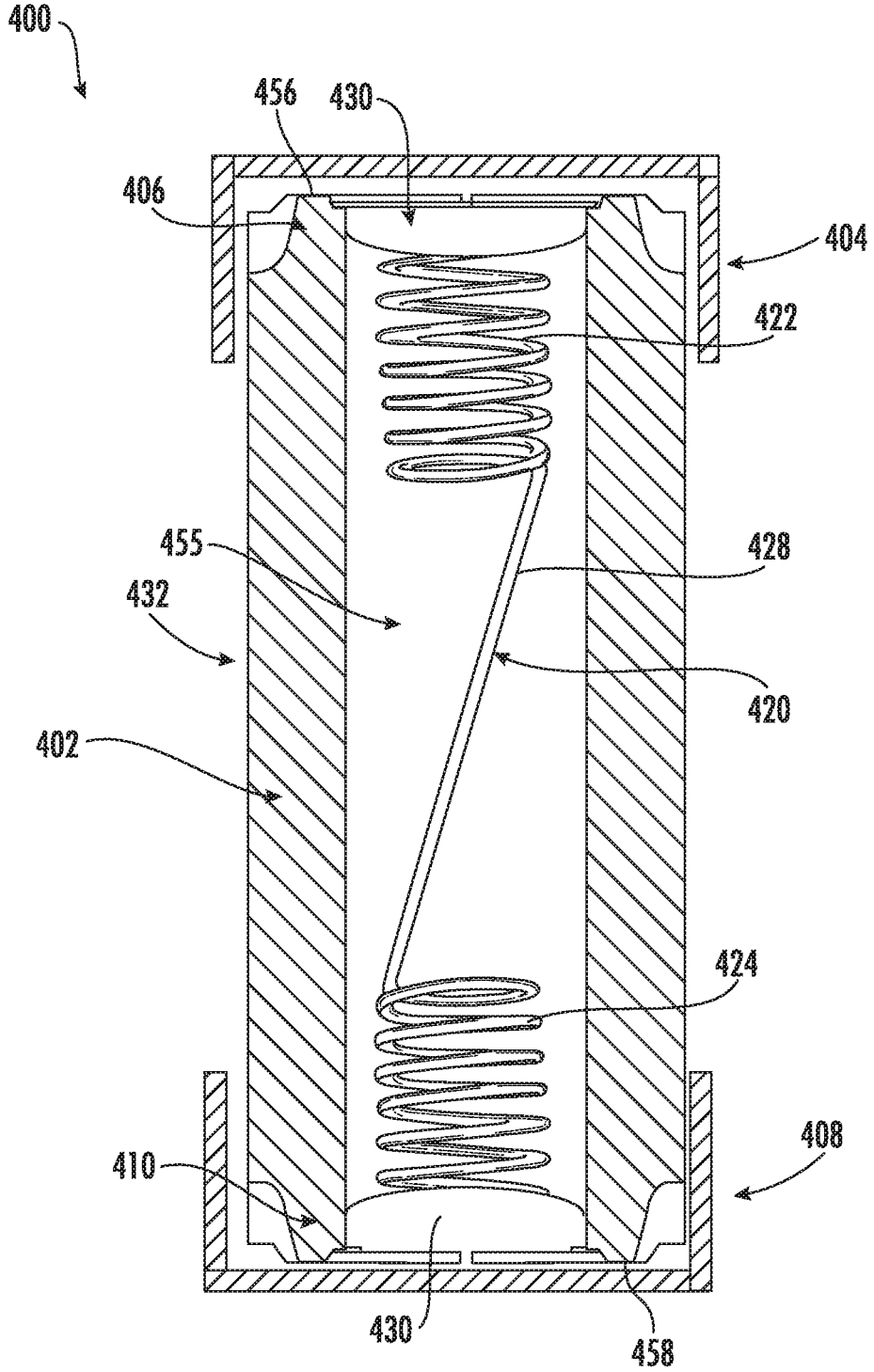
FIG. 6 illustrates side cross-sectional view of a protection device according to exemplary embodiments of the disclosure.

FIG. 6 illustrates a cross-sectional view of an exemplary fuse 400. The body 402 may include a central portion 432 disposed between a first end 406 and a second end 410. As shown, the central portion 432 may have an outer square cross-sectional profile. However, embodiment of the present disclosure are not limited to any particular shape or cross-sectional profile. For example, in some embodiments, the body 402 may have a generally circular profile in cross-section, e.g., as viewed from the first end 406 and the second end 410. The central portion 432 includes a central cavity 455 extending between the first end 406 and the second end 410, and a plurality of exterior surfaces defining the outer cross-sectional profile of a first size. In a non-limiting embodiment, the body 402 includes four (4) generally flat exterior surfaces. The body 402 may be ceramic, plastic, or other suitable electrically non-conducting material. A first endcap 404 may fit over the first end 406 of the body 402, and a second 408 1164 may fit over the second end 410 of the body 402.

As shown, solder 430 may be disposed within the central cavity 455 and along a first end surface 456 of the first end 406 of the body 402. The first coil 422 may have a free end (not shown), which is surrounded by the solder 430 proximate the first end 406 of the body 402. Similarly, the solder 430 may extend along a second end surface 458 of the second end 410 of the body 402. The second coil 424 may have a free end, which is surrounded by the solder 430 proximate the second end 410 of the body 402. In some embodiments, an arc quenching material (e.g., silicone) may be disposed within the central cavity 455.

As further shown, the central wire 428 of the fusible element 420 may be disposed within the central cavity 455 of the body 402. The central wire 428 is a diagonal wire extending between the first and second coils 422, 424. More specifically, the central wire 428 includes a first end 460 integrally coupled with a first end 462 of the first coil 422. A second end 464 of the central wire 428 is integrally coupled with a second end 466 of the second coil 424. The first and second coils 422, 424 are positioned within the first endcap 404 and the second endcap 408, respectively. In some embodiments, the first coil 422 also extends within the central cavity 455 proximate the first end 406 of the body 402, and the second coil 424 extends within the central cavity 455 proximate the second end 410 of the body 402. As described above, depending on the winding direction of the first and second coils 422, 424, when the loops of the first and second coils 422, 424 are supplied an electric current, a magnetic field is created, which helps confine arc plasma, enhancing the breaking capacity of the fuse 400. Although not shown, the loop area of the first and/or second coils could also hold a silicone material for additional arc quenching capability. It will be appreciated that a number coils, thickness of material, and diameter of the loops, among other parameters, may vary, and may be dependent in part on the geometries of the body 402 and the central cavity 455, as well as the rating of the fuse 400.

Although not shown, in some embodiments, the free end of the first and/or second coils 422, 424 may extend along respective first and second end surfaces 456, 458. In yet other embodiments, the fusible element 420 may also extend along the partially along the one or more of the plurality of exterior surfaces of the body 402.

In sum, provided herein is a fusible element having coils disposed at opposite ends of a diagonal wire. The first and second coils may be wound in a same direction, thus creating a magnetic bottle configuration (also called magnetic mirror), which can advantageously confine an arc at the center of the diagonal wire. With the arc confined at the center, damage of the fuse terminals/caps and body will be mitigated. Alternatively, the first and second coils may be wound in opposite directions. As a result, the first and second coils will advantageously repel one another once a strong magnetic field is created, e.g., in the event of an overcurrent condition.

The foregoing discussion has been presented for purposes of illustration and description and is not intended to limit the disclosure to the form or forms disclosed herein. For example, various features of the disclosure may be grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The use of "including," "comprising," or "having" and variations thereof herein is meant to encompass the items listed thereafter and equivalents thereof as well as additional items. Accordingly, the terms "including," "comprising," or "having" and variations thereof are open-ended expressions and can be used interchangeably herein.

The phrases "at least one", "one or more", and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other.

Furthermore, identification references (e.g., primary, secondary, first, second, third, fourth, etc.) are not intended to connote importance or priority but are used to distinguish one feature from another. The drawings are for purposes of illustration only and the dimensions, positions, order and relative sizes reflected in the drawings attached hereto may vary.

Furthermore, the terms "substantial" or "substantially," as well as the terms "approximate" or "approximately," can be used interchangeably in some embodiments, and can be described using any relative measures acceptable by one of ordinary skill in the art. For example, these terms can serve as a comparison to a reference parameter, to indicate a deviation capable of providing the intended function. Although non-limiting, the deviation from the reference parameter can be, for example, in an amount of less than 1%, less than 3%, less than 5%, less than 10%, less than 15%, less than 20%, and so on.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, the present disclosure has been described herein in the context of a particular implementation in a particular environment for a particular purpose. Those of ordinary skill in the art will recognize the usefulness is not limited thereto and the present disclosure may be beneficially implemented in any number of environments for any number of purposes. Thus, the claims set forth below are to be construed in view of the full breadth and spirit of the present disclosure as described herein.

We claim:

1. A fuse comprising:
- a body including a center portion extending between a first end and a second end;
- a first endcap surrounding the first end and a second endcap surrounding the second end; and
- a fusible element disposed within a central cavity of the body, the fusible element comprising:
  - a first coil disposed within the first endcap and a second coil disposed within the second endcap; and
  - a straight central wire extending diagonally between the first and second coils.

2. The fuse according to claim 1, further comprising solder disposed within the first endcap and the second endcap.

3. The fuse according to claim 2, wherein the solder is further disposed between the first end and the first endcap, and between the second end and the second endcap.

4. The fuse according to claim 2, wherein the solder is connected to the first coil and the second coil.

5. The fuse according to claim 1, further comprising a first tube of the first endcap and a second tube of the second endcap, wherein the first coil is coupled to the first tube, and wherein the second coil is coupled to the second tube.

6. The fuse according to claim 5, wherein the first coil wraps partially around the first tube, and wherein the second coil wraps partially around the second tube.

7. The fuse according to claim 1, further comprising an arc quenching material within the body.

8. The fuse according to claim 1, wherein the first and second coils are wound in a same direction.

9. The fuse according to claim 1, wherein the first and second coils are wound in opposite directions.

10. A protection device comprising:
- a body;
- a first endcap surrounding a first end of the body, and a second endcap surrounding a second end of the body; and
- a fusible element extending between the first end of the body and the second end of the body, wherein the fusible element is disposed within a central cavity of the body, and wherein the fusible element comprises:
  - a first coil disposed within the first endcap and a second coil disposed within the second endcap; and
  - a straight central wire extending diagonally between the first and second coils.

11. The protection device according to claim 10, further comprising solder disposed within the first endcap and the second endcap, wherein the first and second coils are connected to the solder.

12. The protection device according to claim 10, further comprising a first tube of the first endcap and a second tube of the second endcap, wherein the first coil is coupled to the first tube, and wherein the second coil is coupled to the second tube.

13. The protection device according to claim 12, wherein the first coil wraps around the first tube, and wherein the second coil wraps around the second tube.

14. The protection device according to claim 10, wherein the first and second coils are one of: wound in a same direction, and wound in opposite directions.

15. A fusible device comprising:
- a hollow body;
- a first endcap surrounding a first end of the hollow body, and a second endcap surrounding a second end of the hollow body; and
- a fusible element extending between the first end of the hollow body and the second end of the body, wherein the fusible element is disposed within a central cavity of the hollow body, and wherein the fusible element comprises:
  - a first coil partially disposed within the first endcap, the first coil having a plurality of loops wound about a central axis;
  - a second coil having a plurality of loops wound about the central axis; and
  - a straight central wire having a first end integrally coupled to the first coil and a second end integrally coupled to the second coil, the straight central wire extending diagonally through the central cavity with respect to the central axis.

16. The fusible device of claim 15, further comprising:
- solder disposed between the first endcap and the first end of the hollow body, and between the second endcap and the second end of the body, wherein the first and second coils are connected to the solder.

17. The fusible device of claim 15, further comprising:
- a first support extending from an interior of the first endcap and towards the first end of the hollow body; and
- a second support extending from an interior of the second endcap and towards the second end of the hollow body, wherein the first coil is wound about the first support, and wherein the second coil is wound about the second support.

18. The fusible device of claim 15, wherein the first and second coils are one of: wound in a same direction about the central axis, and wound in opposite directions about the central axis.

* * * * *